US006128941A

United States Patent [19]

Russell

[11] Patent Number: 6,128,941

[45] Date of Patent: Oct. 10, 2000

[54] PIPE BENDING MACHINE

[75] Inventor: Kevin James Russell, Evansburg, Canada

[73] Assignee: BendKing Inc., Evansburg, Canada

[21] Appl. No.: 09/357,550

[22] Filed: Jul. 20, 1999

[30] Foreign Application Priority Data

Aug. 26, 1998 [CA] Canada ..... 2245996

[51] Int. Cl.[7] ..... B21D 5/02; B21D 9/14; B21D 37/00

[52] U.S. Cl. ..... 72/383; 72/386; 72/387

[58] Field of Search ..... 72/380, 383, 386, 72/387, 389.8, 149, 157, 158, 159

[56] References Cited

U.S. PATENT DOCUMENTS 3,335,588 8/1967 Cummings .
4,537,053 8/1985 Schwarze ..... 72/157
4,798,073 1/1989 Dischler ..... 72/218
5,123,272 6/1992 Heaman ..... 72/389.8
5,353,622 10/1994 Theener .

OTHER PUBLICATIONS

Abstract of U.S. Patent No. 4,102,169, Koser, issued Jul. 25, 1978, 2 pages.

*Primary Examiner*—Rodney A. Butler
*Attorney, Agent, or Firm*—Christensen O'Connor Johnson and Kindness PLLC

[57] ABSTRACT

A pipe bending machine includes a horizontal pipe support platform defining a horizontal pipe feed channel. A first pipe engaging member is positioned on a first side of the pipe feed channel. A second pipe engaging member and a third pipe engaging member are arranged in spaced relation on a second side of the pipe feed channel. Either the first pipe engaging member or the second pipe engaging member and third pipe engaging member are movable into the pipe feed channel, thereby exerting a bending force upon a pipe positioned in the pipe feed channel.

8 Claims, 5 Drawing Sheets

PIPE BENDING MACHINE

FIELD OF THE INVENTION

The present invention relates to a pipe bending machine and, in particular, a pipe bending machine used to bend large diameter pipe that must be moved using lifting equipment.

BACKGROUND OF THE INVENTION

Most pipe bending machines used to bend large diameter pipe have similar principles of operation. Three bending shoes are provided. Usually there are two lower bending shoes in spaced relation which support the pipe and one upper bending shoe positioned above the pipe at an intermediate position between the two lower bending shoes. Relative movement of the bending shoes toward each other results in a force being exerted to bend the pipe. U.S. Pat. No. 5,353,622 which was issued to Theener in 1994 illustrates such a pipe bending machine.

In order to bend large diameter pipe, there is usually required a number of other machines on site, in addition to the pipe bending machine. Lifting equipment is required in order to lift the large diameter pipe on and off the pipe bending machine and move the pipe laterally through the pipe bending machine as the pipe is being bent. In addition, the pipe must be supported as it is being bent. If not properly supported, the pipe has an increasing tendency to twist as the bend progresses.

SUMMARY OF THE INVENTION

What is required is a pipe bending machine which will reduce the degree to which ancillary lifting equipment is required when bending pipe.

According to the present invention there is provided a pipe bending machine which includes a horizontal pipe support platform defining a horizontal pipe feed channel. A first pipe engaging member is positioned on a first side of the pipe feed channel. A second pipe engaging member and a third pipe engaging member are arranged in spaced relation on a second side of the pipe feed channel. One of the first pipe engaging member or the second pipe engaging member and third pipe engaging member are movable into the pipe feed channel, thereby exerting a bending force upon a pipe positioned in the pipe feed channel.

The pipe bending machine, as described above, is fed horizontally. This greatly reduces the need for ancillary pipe handling equipment, as the pipe lays upon the ground adjacent to the pipe bending machine. It is preferred that the first pipe engaging member, the second pipe engaging member and the third pipe engaging member are all moveable.

Although beneficial results may be obtained through the use of the pipe bending machine, as described above, there are problems associated with feeding a pipe into the pipe engaging members from a horizontal surface. Even more beneficial results may, therefore, be obtained when the pipe engaging members each have a pipe receiving cradle. The pipe receiving cradle has a forwardly and downwardly extending pipe feed ramp. Upon movement of the pipe engaging member, a pipe laying along the pipe feed channel is lifted from the surface of the horizontal pipe support and directed along the pipe feed ramp into the pipe receiving cradle of said pipe engaging member.

The preferred manner of moving the pipe engaging members in a horizontal orientation is for the second pipe engaging member and the third pipe engaging member to be elongate. Each of the second and third pipe engaging members has a first end and a second end, with the first end facing the other of the pipe engaging members. The first end is pivotally secured for movement about a substantially vertical axis. The second end is secured to a telescopically extendible actuator. Telescopic movement of the actuator pivots said pipe engaging member about said vertical axis.

Although beneficial results may be obtained through the use of the pipe bending machine, as described above, ancillary equipment is required to move the pipe along the pipe feed channel. Even more beneficial results may, therefore, be obtained when a winch is mounted on the pipe support platform which has an attachment line. The attachment line is attached to a pipe and the winch is used to draw the pipe along the pipe feed channel.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
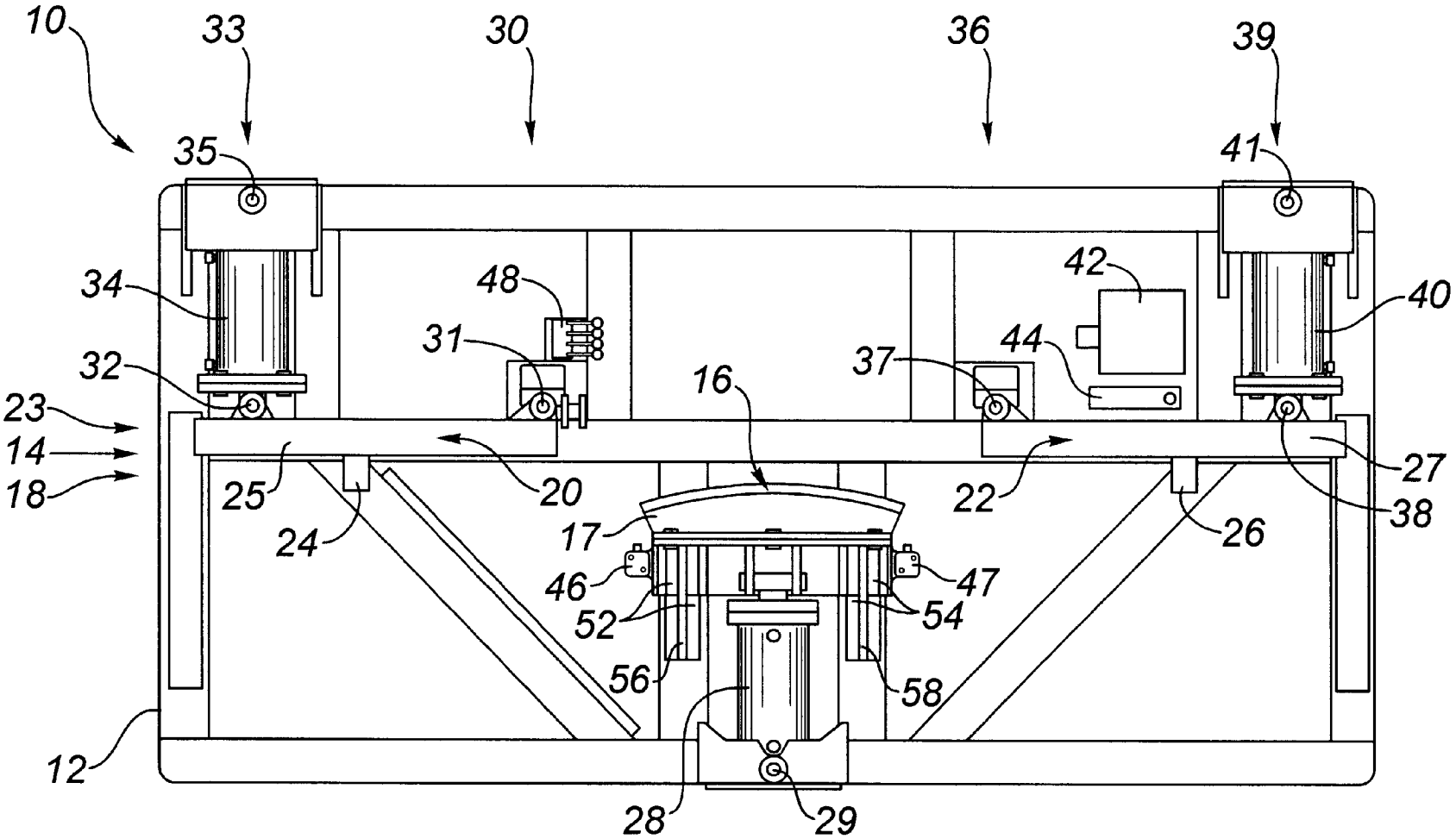
FIG. 1 is a top plan view, in partial section, of a pipe bending machine constructed in accordance with the teachings of the present invention.

The preferred embodiment, a bending pipe machine generally identified by reference numeral 10, will now be described with reference to FIGS. 1 through 6.

Referring to FIG. 1, pipe bending machine 10 includes a horizontal pipe support platform 12 defining a horizontal pipe feed channel 14. A first pipe engaging member 16 is positioned on a first side 18 of the pipe feed channel 14. First pipe engaging member 16 has a pipe receiving cradle 17 at its face. A second pipe engaging member 20 and a third pipe engaging member 22 are arranged in spaced relation on a second side 23 of the pipe feed channel 14. Second and third pipe engaging members 20 and 22 also are known as "wiper dies". First pipe engaging member 16 also is known as a "pinch die". A first wedge shaped ramp 24 is attached to a first pipe receiving cradle 25 of second pipe engaging member 20. A second wedge shaped ramp 26 is attached to a second pipe receiving cradle 27 of third pipe engaging member 22.

First pipe engaging member 16 is connected to a first hydraulically driven extendable cylinder 28 pivotally attached to frame 12 at position 29. Second pipe engaging member 20 is pivotally attached at a first end 30 to frame 12 at position 31 and has a pivotal connection 32 at a second end 33 to a second hydraulically driven extendable cylinder 34 that is in turn pivotally attached to frame 12 at position 35. Third pipe engaging member 22 is pivotally connected at a first end 36 to frame 12 at position 37 and has a pivotal connection 38 at a second end 39 to a third hydraulically driven extendable cylinder 40 that is in turn pivotally attached to frame 12 at position 41.

First, second and third extendable cylinders 28, 34 and 40 are powered by a hydraulic motor and pump assembly 42. A supply of hydraulic fluid is maintained in fluid reservoir 44. Relief valves 46 and 47 are provided on at least one of pipe engaging members 16, 20 and 22 to prevent an excess amount of pressure being applied to a length of pipe when said length of pipe is to be bent.

Hydraulic motor and pump assembly 42, first, second and third extendable cylinders 28, 34 and 40, and first, second and third pipe engaging members 16, 20 and 22 are operated individually or in various combinations from a control tower 48. Preferably control tower 48 is capable of being folded down to a position substantially coplanar with frame 12, to reduce the overall height of machine 10 when machine 10 is being shipped between locations.

Figure 2:
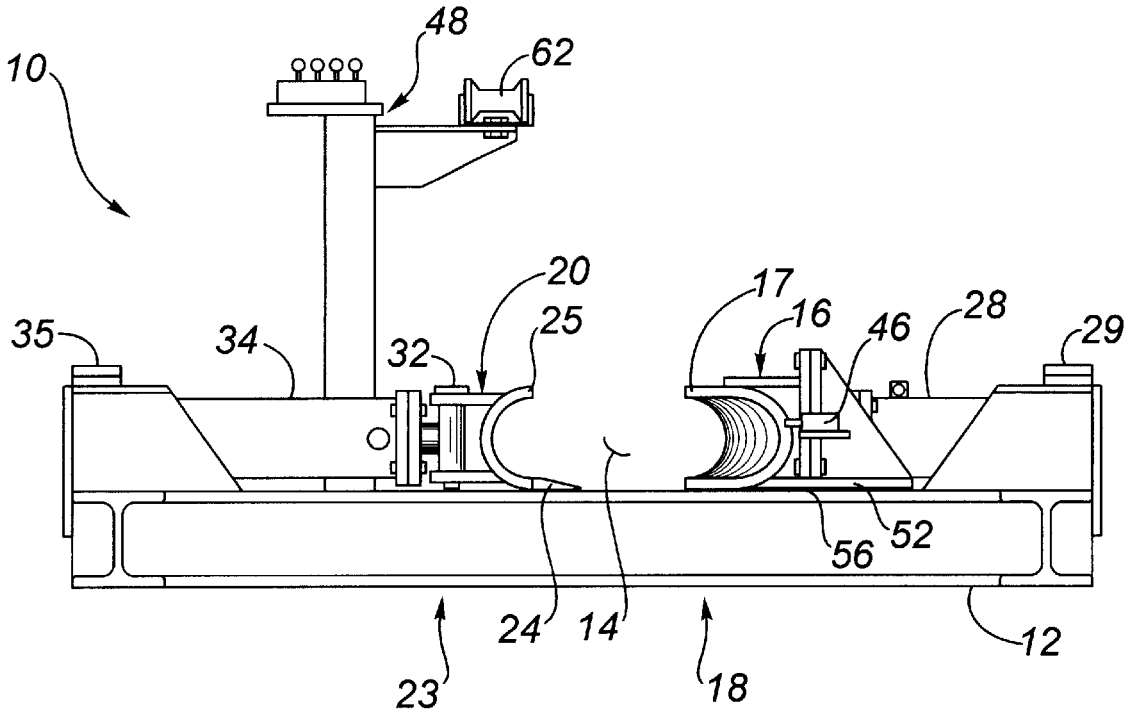
FIG. 2 is an end elevation view of the pipe bending machine illustrated in FIG. 1, in which the pipe engaging members are separated to allow access by the length of pipe to be bent.
Figure 3:
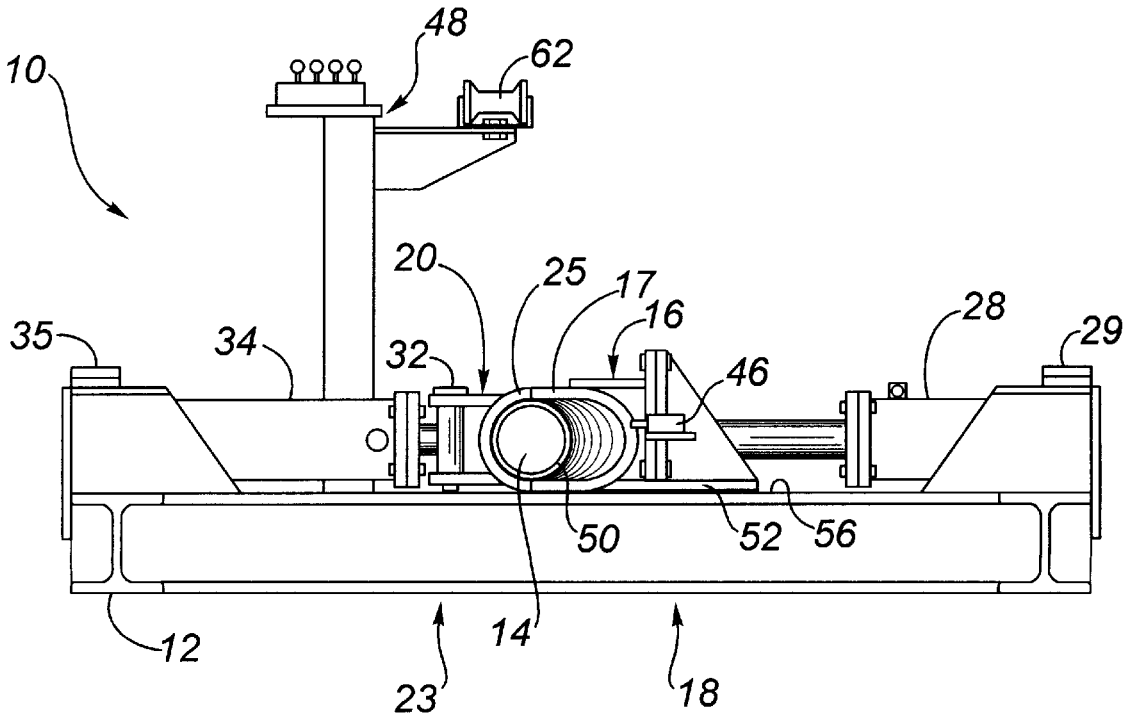
FIG. 3 is an end elevation view of the pipe bending machine illustrated in FIG. 1, in which a length of pipe is positioned between and engaged by the pipe engaging members.

Referring to FIGS. 2 and 3, for each of first, second and third pipe engaging members 16, 20 and 22 there is a first position and a second position. In the first position of pipe engaging member 16 extendable cylinder 28 is in a retracted position and first pipe engaging member is distanced from pipe feed channel 14 as illustrated in FIG. 2. In the second position extendable cylinder 28 is in the extended position and first pipe engaging member 16 engages a length of pipe 50 in pipe feed channel 14 as illustrated in FIG. 3. The first position and the second position of each of second pipe engaging member 20 and third pipe engaging member 22 are related to pipe feed channel 14 in substantially the same way as first and second positions of first pipe engaging member 16.

Referring to FIG. 1, the direction of movement of first pipe engaging member 16 into and out of pipe feed channel 14 is constrained to be substantially at right angles to pipe feed channel 14 by sliders 52 and 54 attached to first pipe engaging member 16 that travel along slider tracks 56 and 58 respectively.

Figure 4:
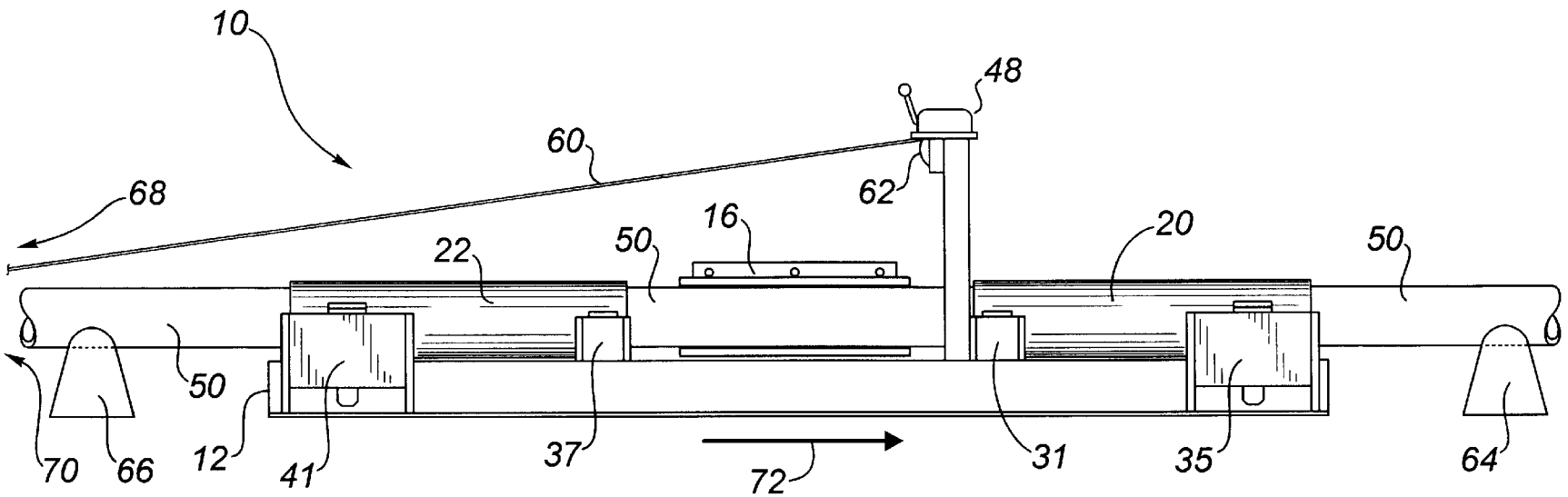
FIG. 4 is a side elevation view of the pipe bending machine and length of pipe illustrated in FIG. 3.

Referring to FIG. 2, when machine 10 is prepared to receive a length of pipe each of first, second and third pipe engaging members 16, 20 and 22 are in the first position. Referring to FIG. 3, first, second and third pipe engaging members 16, 20 and 22 are each moved to the respective second positions to engage a length of pipe 50 fed through pipe feed channel 14. Referring to FIG. 4, pipe 50 is pulled along pipe feed channel 14 by a cable 60 attached to winch 62.

Figure 5:
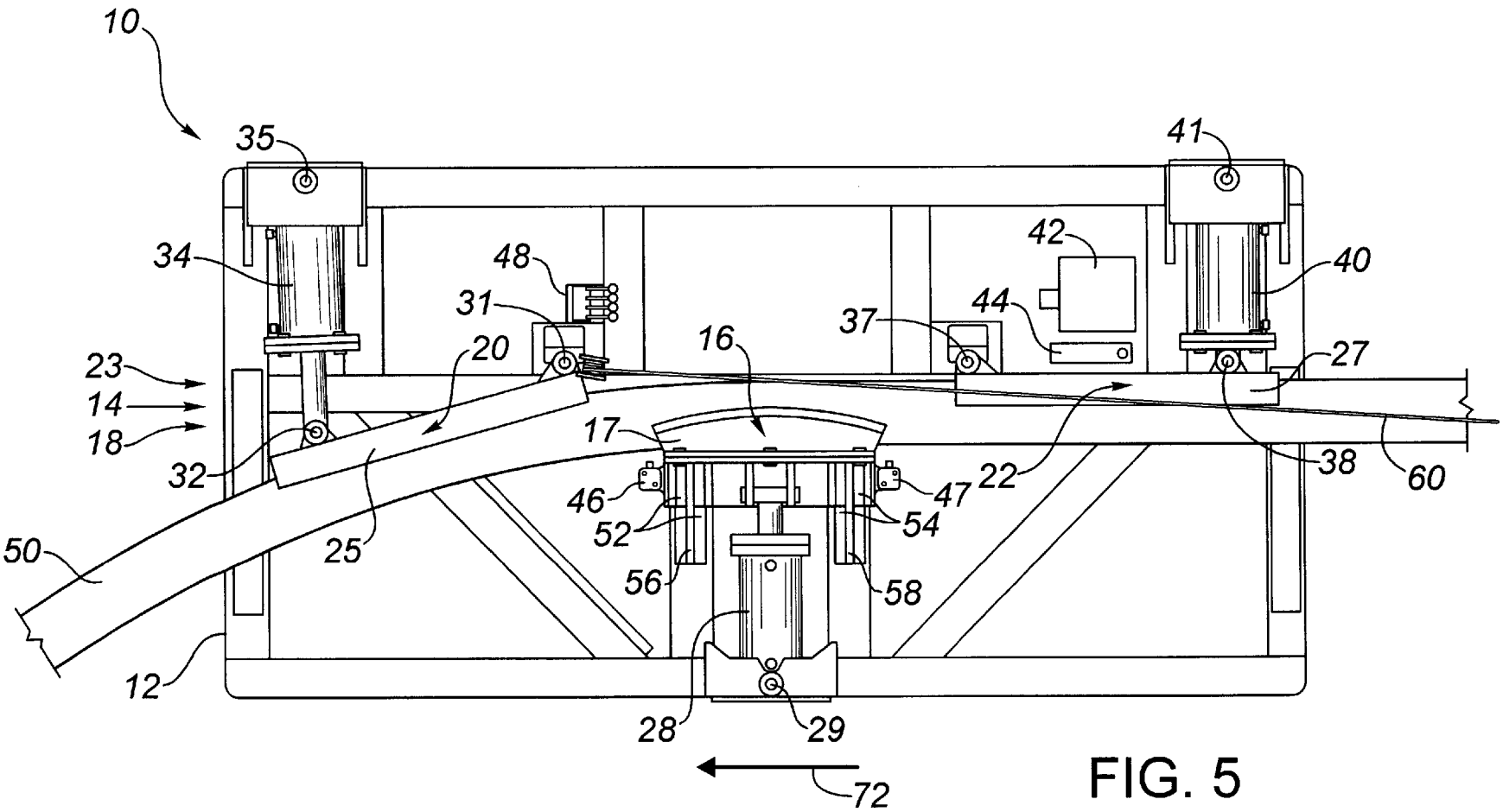
FIG. 5 is a top plan view of the machine and length of pipe illustrated in FIG. 3, in which two of a set of three of pipe engaging members are being used to bend the length of pipe.
Figure 6:
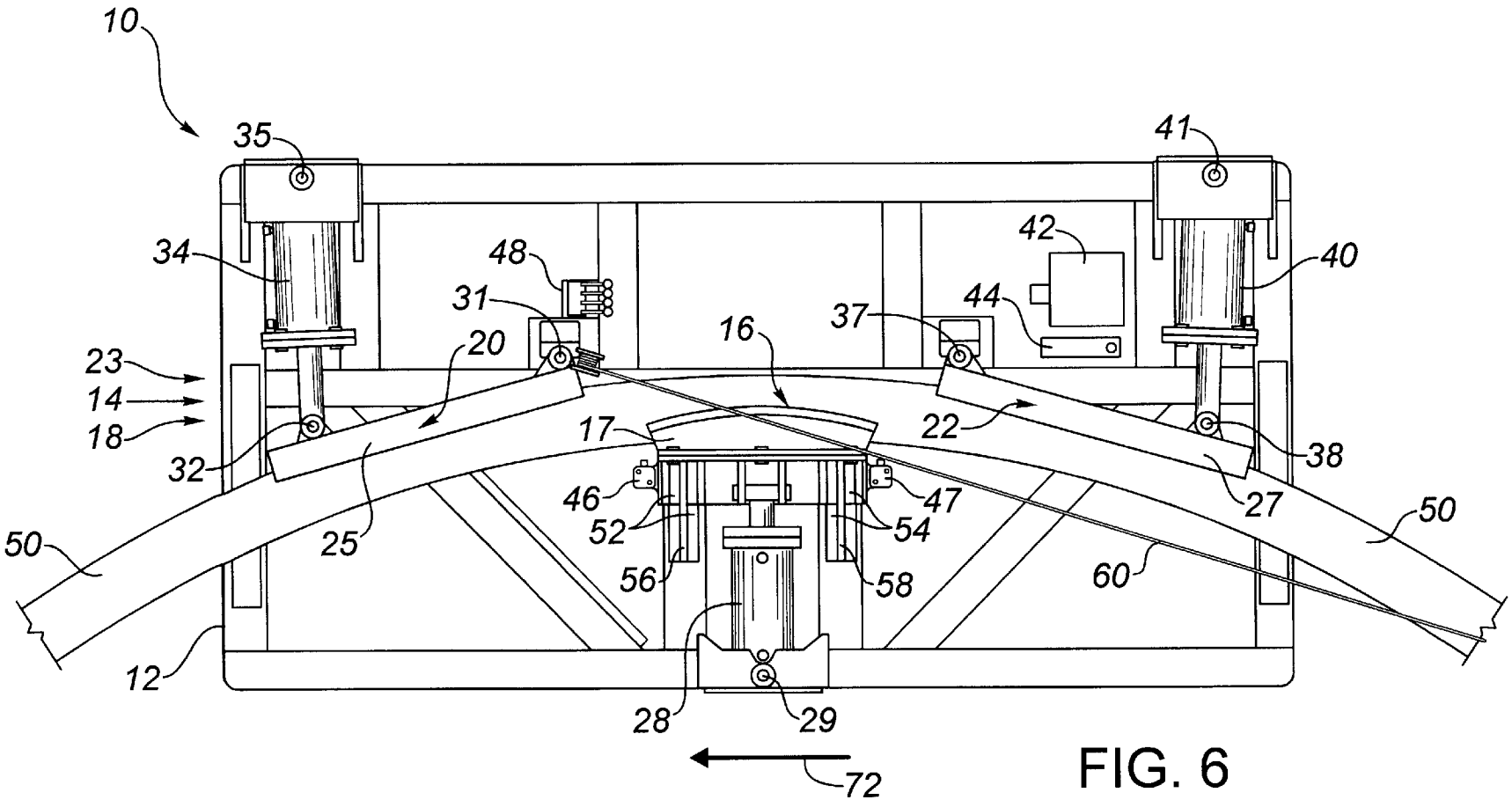
FIG. 6 is a top plan view of the machine and length of pipe illustrated in FIG. 1, in which all three of a set of three pipe engaging members are being used to bend the length of pipe.

The use and operation of apparatus 10 will now be described with reference to FIGS. 1 through 6. A first step is to prepare machine 10 for receiving a length of pipe that is to be bent by placing pipe engaging members 16, 20 and 22 of machine 10 in the respective first positions distant from pipe feed channel 14 as illustrated in FIGS. 1 and 2. A second step is to place the length of pipe 50 into feed channel 14 by means such as lifting equipment. The portions of length of pipe 50 which extend beyond the dimensions of machine 10 are supported either on the ground or on portable pipe supports 64 and 66 as illustrated in FIG. 4. A third step is to extend cable 60 away from winch 62 and attach a remote end of cable 60 to a first end (not shown) of length of pipe 50, as illustrated in FIG. 4. A fourth step is to move length of pipe 50 laterally along pipe feed channel 14 in the direction shown by arrow 72 by means of cable 60 and winch 62. The length of pipe 50 is positioned so that the center of the position along length of pipe 50 at which length of pipe 50 is to be bent is positioned adjacent to first pipe engaging member 16. A fifth step is to operate expandable cylinders 28, 34 and 40 respectively to move pipe engaging members 16, 20 and 22 into the respective second positions and engage length of pipe 50 as illustrated in FIG. 3. As pipe engaging members 20 and 22 move into pipe feed channel 14 ramps 24 and 26 engage length of pipe 50 and lift said pipe into position within pipe receiving cradles 17, 25 and 27 of pipe engaging members 16, 20 and 22 respectively. As first pipe engaging member 16, second pipe engaging member 20 and third pipe engaging member 22 move into pipe feed channel 14, a bending force is exerted upon length of pipe 50 positioned in the pipe feed channel 14. Referring to FIG. 5, bending length of pipe 50 includes a sixth step in which length of pipe 50 is bent by operating extendable cylinder 34 to apply a bending force to length of pipe 50 through pipe engaging member 20 while maintaining pipe engaging members 16 and 22 in fixed positions. Length of pipe 50 is bent toward first side 18 of pipe feed channel 14. The plane of the bend in length of pipe 50 is substantially coplanar with frame 12. Referring to FIG. 6, further bending of length of pipe 50 at the same position includes a seventh step in which bent length of pipe 50 is bent further by operating extendable cylinder 40 to apply a bending force to length of pipe 50 through pipe engaging member 22 while maintaining pipe engaging members 16 and 20 in fixed positions. A plurality of bends can be made in length of pipe 50. An eighth step is to move bent length of pipe 50 laterally along pipe feed channel 14 by means of cable 60 and winch 62 until the center of the position on length of pipe 50 at which second or subsequent bends is to be made in length of pipe 50 is adjacent to pipe engaging member 16. When the second bend in length of pipe 50 is in the same direction as the first bend then the bent length of pipe is maintained in the same attitude toward the frame 12 as when making the first bend. When the second bend in length of pipe 50 is to be in the opposite direction as the first bend then the pipe is inverted relative to the plane of the first bend before making the second bend.

It will be apparent to one skilled in the art that modifications may be made to the illustrated embodiment without departing from the spirit and scope of the invention as hereinafter defined in the claims.

What is claimed is:

1. A pipe bending machine, including:

a fixed horizontal pipe support platform defining a horizontal pipe feed channel;

a first pipe engaging member positioned laterally on a first side of the pipe feed channel;

a first actuator moving the first pipe engaging member into the pipe feed channel, thereby exerting a bending force upon a pipe positioned in the pipe feed channel;

an elongate second pipe engaging member and an elongate third pipe engaging member arranged in spaced apart end to end relation on a second side of the pipe feed channel, each of the second pipe engaging member and the third pipe engaging member having a first end and a second end, the first end of the second pipe engaging member being positioned adjacent to the first end of the third pipe engaging member, the first end of each of the second pipe engaging member and the third pipe engaging member being pivotally secured to the support platform for movement about a substantially vertical axis;

a second actuator secured to the second end of the second pipe engaging member whereby the second pipe engaging member is moved into the pipe feed channel to exert a bending force upon the pipe positioned in the pipe feed channel;

a third actuator secured to the second end of the third pipe engaging member whereby the third pipe engaging member is moved into the pipe feed channel, to exert a bending force upon the pipe positioned in the pipe feed channel;

each of the first pipe engaging member, the second pipe engaging member and the third pipe engaging member has a pipe receiving cradle, the pipe receiving cradle having a forwardly and downwardly extending pipe feed ramp such that upon movement of the pipe engaging member, the pipe laying along the pipe feed channel is lifted from the surface of the horizontal pipe support and directed along the pipe feed ramp into the pipe receiving cradle of said pipe engaging member.

2. The pipe bending machine as defined in claim 1, wherein a winch is mounted on the pipe support platform and has an attachment line, such that the attachment line is attached to a pipe and the winch is used to draw the pipe along the pipe feed channel.

3. The pipe bending machine as defined in claim 1, wherein at least one of the first pipe engaging member or the second pipe engaging member and third pipe engaging member has a pressure relief valve being movable into the pipe feed channel, thereby exerting a bending force upon a pipe positioned in the pipe feed channel.

4. A pipe bending machine, including:

a fixed horizontal pipe support platform defining a horizontal pipe feed channel;

a first pipe engaging member positioned laterally on a first side of the pipe feed channel;

an elongate second pipe engaging member and an elongate third pipe engaging member arranged in spaced apart end to end relation on a second side of the pipe feed channel, each of the second pipe engaging member and the third pipe engaging member having a first end and a second end, the first end of the second pipe engaging member being positioned adjacent to the first end of the third pipe engaging member;

the first pipe engaging member being movable into the pipe feed channel, thereby exerting a bending force upon a pipe positioned in the pipe feed channel;

at least one of the second pipe engaging member and the third pipe engaging member being movable into the pipe feed channel with the first end pivotally secured to the support platform for movement about a fixed substantially vertical axis and the second end secured to a telescopically extendible actuator, such that upon telescopic movement of the actuator, the at least one of the second pipe engaging member and the third pipe engaging member pivots about the vertical axis.

5. The pipe bending machine as defined in claim 4, wherein the second pipe engaging member and the third pipe engaging member both are pivotally secured for movement about the vertical axis.

6. The pipe bending machine as defined in claim 4, wherein the at least one of the second pipe engaging member and the third pipe engaging member that is moveable has a pipe receiving cradle, the pipe receiving cradle having a forwardly and downwardly extending pipe feed ramp such that upon movement of the at least one of the second pipe engaging member and the third pipe engaging member, a pipe laying along the pipe feed channel is lifted from the surface of the horizontal pipe support and directed along the pipe feed ramp into the pipe receiving cradle of said pipe engaging member.

7. The pipe bending machine as defined in claim 4, wherein a winch is mounted on the pipe support platform and has an attachment line, such that the attachment line is attached to a pipe and the winch is used to draw the pipe along the pipe feed channel.

8. The pipe bending machine as defined in claim 1, wherein portable pipe supports are used to maintain in a substantially horizontal orientation that portion of a pipe being bent that protrudes past the pipe support platform.

* * * * *